US010024555B2

(12) United States Patent
Yanase et al.

(10) Patent No.: US 10,024,555 B2
(45) Date of Patent: Jul. 17, 2018

(54) OUTDOOR UNIT OF AIR CONDITIONER

(71) Applicant: Mitsubishi Electric Corporation, Tokyo (JP)

(72) Inventors: Tomoya Yanase, Tokyo (JP); Toshiyuki Kubono, Tokyo (JP); Hiroyuki Jinnai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/127,452

(22) PCT Filed: Jan. 14, 2015

(86) PCT No.: PCT/JP2015/050804
§ 371 (c)(1),
(2) Date: Sep. 20, 2016

(87) PCT Pub. No.: WO2015/151544
PCT Pub. Date: Oct. 8, 2015

(65) Prior Publication Data

US 2017/0205086 A1 Jul. 20, 2017

(30) Foreign Application Priority Data

Apr. 4, 2014 (JP) ..... 2014-077923

(51) Int. Cl.
*F24F 1/22* (2011.01)
*F24F 1/24* (2011.01)
*F24F 13/20* (2006.01)

(52) U.S. Cl.
CPC ..... *F24F 1/22* (2013.01); *F24F 1/24* (2013.01); *F24F 13/20* (2013.01); *F24F 2013/207* (2013.01)

(58) Field of Classification Search
CPC ..... F24F 1/22; F24F 13/20; F24F 1/24
See application file for complete search history.

(56) References Cited

U.S. PATENT DOCUMENTS 7,876,574 B2 1/2011 Takeichi et al.
2009/0260382 A1 10/2009 Takeichi et al.
(Continued)

FOREIGN PATENT DOCUMENTS

EP 1 956 308 A1 8/2008
JP S58-93758 U 6/1983
(Continued)

OTHER PUBLICATIONS

International Search Report of the International Searching Authority dated Apr. 21, 2015 for the corresponding International application No. PCT/JP2015/050804 (and English translation).
(Continued)

*Primary Examiner* — Emmanuel Duke
(74) *Attorney, Agent, or Firm* — Posz Law Group, PLC

(57) ABSTRACT

An outdoor unit of an air conditioner includes a partition plate that separates a machine compartment, in which a compressor unit, a refrigerant pipe, and an electrical-part storage are disposed, and an air blower compartment; an electrical-part storage that is disposed so as to extend from the machine compartment side of the partition plate to the air blower compartment side of the partition plate, and that stores therein an electrical part; an auxiliary board that is disposed in the machine compartment and on which an electrical part that is other than the electrical part installed in the electrical-part storage, is installed; and a board fixing portion that is interposed between the electrical-part storage located in the machine compartment and the auxiliary board to fix the auxiliary board thereto.

9 Claims, 14 Drawing Sheets

(56) References Cited

U.S. PATENT DOCUMENTS

| | | | | |
|---|---|---|---|---|
| 2010/0193164 | A1* | 8/2010 | Wakatsuki | F24F 1/24 165/121 |
| 2010/0294466 | A1* | 11/2010 | Shimaoka | F24F 1/24 165/104.33 |

FOREIGN PATENT DOCUMENTS

| | | | | |
|---|---|---|---|---|
| JP | H06-180131 | A | | 6/1994 |
| JP | 2006-145082 | A | | 6/2006 |
| JP | 2006145082 | A | * | 6/2006 |
| JP | 2006-183883 | A | | 7/2006 |
| JP | 2007-127377 | A | | 5/2007 |
| JP | 2007-127378 | A | | 5/2007 |
| JP | 2007-127380 | A | | 5/2007 |
| JP | 2013-104622 | A | | 5/2013 |
| JP | 2013104622 | A | * | 5/2013 |

OTHER PUBLICATIONS

Office Action dated May 18, 2017 issued in corresponding CN patent application No. 201510151521.1 (and partial English translation).

Office Action dated Mar. 7, 2017 issued in corresponding JP patent application No. 2014-077923 (and English translation).

Office Action dated Dec. 4, 2017 issued in corresponding Russian patent application No. 2016142812/12 (068584) (and English translation).

Office Action dated Dec. 13, 2017 issued in corresponding CN patent application No. 201510151521.1 (and English translation).

* cited by examiner

OUTDOOR UNIT OF AIR CONDITIONER

CROSS REFERENCE TO RELATED APPLICATIONS

This application is a U.S. national stage application of International Patent Application No. PCT/JP2015/050804 filed on Jan. 14, 2015, which claims priority to Japanese Patent Application No. 2014-077923 filed on Apr. 4, 2014, the disclosures of which are incorporated herein by reference.

TECHNICAL FIELD

The present invention relates to an outdoor unit of an air conditioner.

BACKGROUND

A conventional outdoor unit of an air conditioner is configured to include an air blower compartment in which an air blower fan is disposed, a machine compartment in which a compressor unit, a refrigerant pipe group, and an electrical-part storage are disposed, and a partition plate that separates the air blower compartment and the machine compartment. When a function is to be added to the outdoor unit configured as described above or when the outdoor unit configured as described above controls greater performance than that of a conventional outdoor unit, it is necessary to install additional parts corresponding to the additional function or the performance. In order to ensure the space for the additional parts as described above to be installed, it is necessary to increase the size of the control board or add an auxiliary board separate from the control board. In the case where the size of the control board is increased, it is necessary to change peripheral parts around the control board, such as a side plate, a top plate, and a casing that constitute the outdoor unit. This means that these parts cannot be standardized and thus the productivity and serviceability degrade.

In order to solve the problems as described above, the structure of a conventional outdoor unit is disclosed in Patent Literature 1 listed below in which a protective cover that covers the control board is provided from the viewpoint of protecting workers, and an auxiliary board on which control elements are mounted is attached to the outer surface of the protective cover.

PATENT LITERATURE

Patent Literature 1: Japanese Patent Application Laid-open No. 2007-127380

In the conventional technique disclosed in Patent Literature 1 listed above, an electrical-part storage is disposed in a machine compartment, and further the electrical-part storage is disposed so as to extend in the vertical direction of the casing. Therefore, there is no problem with the workability of wiring between the control board and the auxiliary board. However, when the conventional technique described above is applied to a general outdoor unit that uses an electrical-part storage that extends in the horizontal direction of the casing of the outdoor unit so as to extend across the machine compartment and the air blower compartment, the auxiliary board is located on the lower surface side of a protective cover that covers the control board. That is, the auxiliary board is located on the lower surface side of the control board in such a manner that electrical parts installed on the control board are opposed to the electrical parts installed on the auxiliary board. Therefore, there is almost no wiring space between the control board and the auxiliary board. This degrades the workability of various types of wiring within the machine compartment. Further, because it is difficult to visually recognize the wiring locations, this may cause faulty wiring. There is also a problem in that the serviceability with regard to board replacement is degraded.

SUMMARY

The present invention has been achieved to solve the above problems, and an object of the present invention is to provide an outdoor unit of an air conditioner that can achieve further improvement in the productivity and serviceability.

In order to solve the above problems and achieve the object, an aspect of the present invention is an outdoor unit of an air conditioner, including: a partition plate that separates a machine compartment and an air blower compartment; an electrical-part storage that is disposed so as to extend from the machine compartment side of the partition plate to the air blower compartment side of the partition plate, and that stores therein an electrical part; a board that is disposed in the machine compartment and on which an electrical part that is other than the electrical part installed in the electrical-part storage, is installed; and a board fixing portion that is interposed between the electrical-part storage located in the machine compartment and the board to fix the board thereto.

According to the present invention, further improvement in the productivity and serviceability can be achieved.

DETAILED DESCRIPTION

Exemplary embodiments of an outdoor unit of an air conditioner according to the present invention will be explained below in detail with reference to the accompanying drawings. The present invention is not limited to the embodiments.

Embodiment

Figure 1:
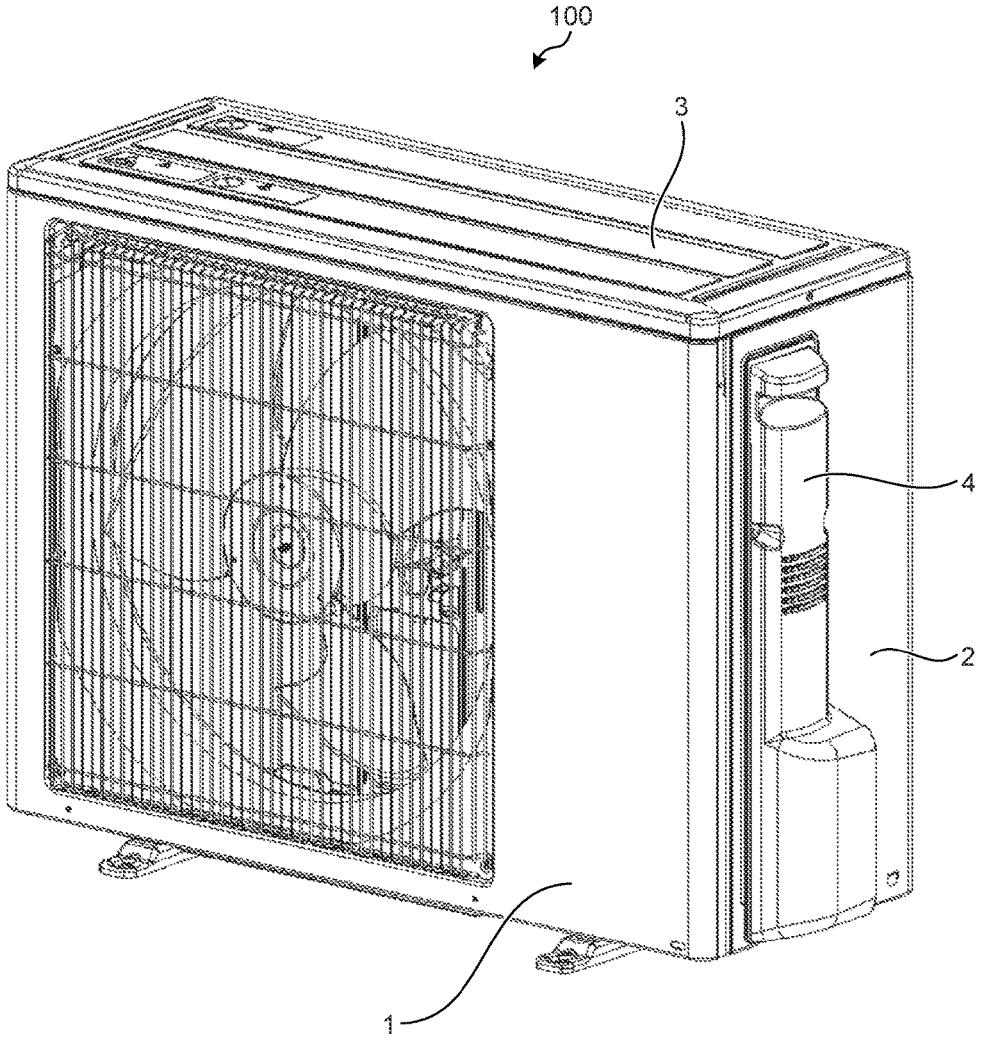
FIG. 1 is an exterior perspective view of an outdoor unit of an air conditioner according to an embodiment of the present invention.
Figure 2:
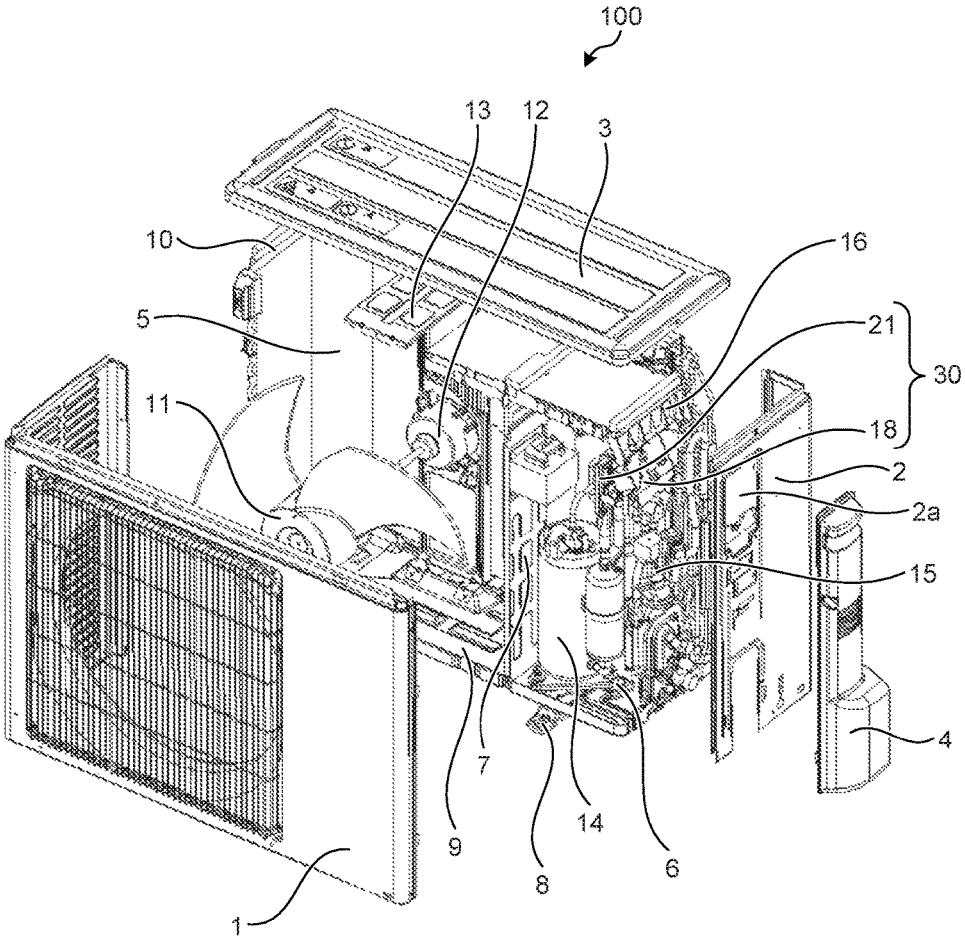
FIG. 2 is an exploded perspective view of the outdoor unit illustrated in FIG. 1.
Figure 3:
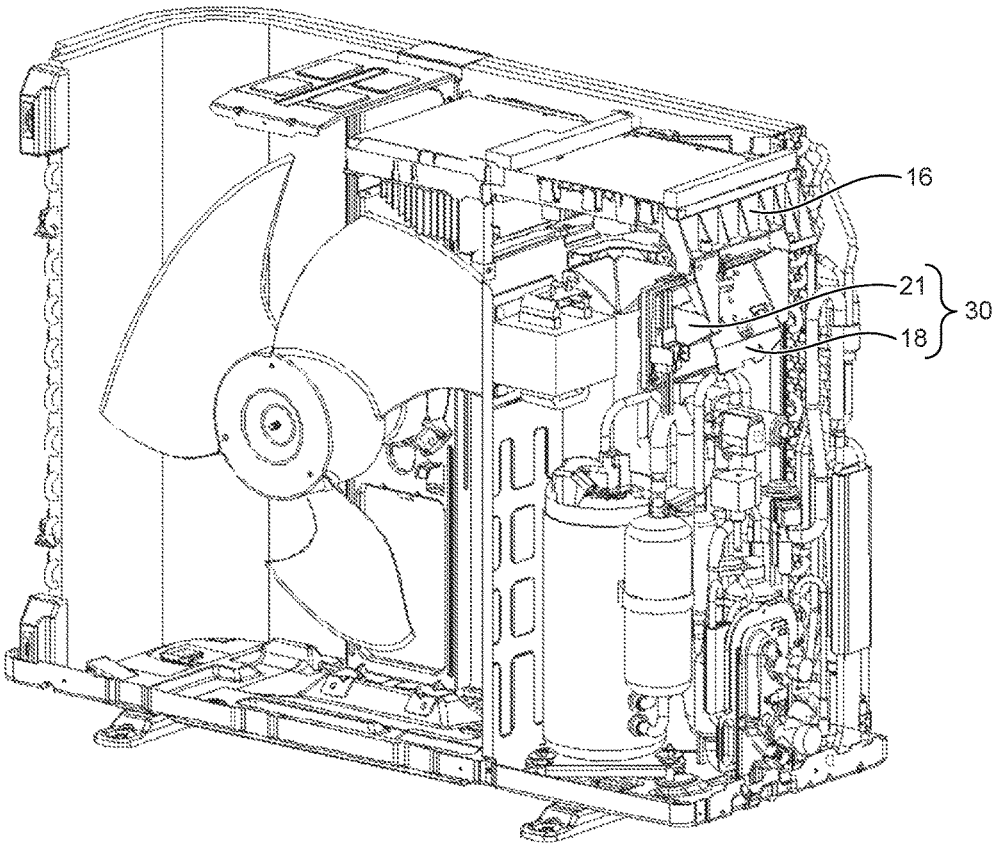
FIG. 3 is an interior perspective view of the outdoor unit with a board fixing portion attached to an electrical-part storage.
Figure 4:
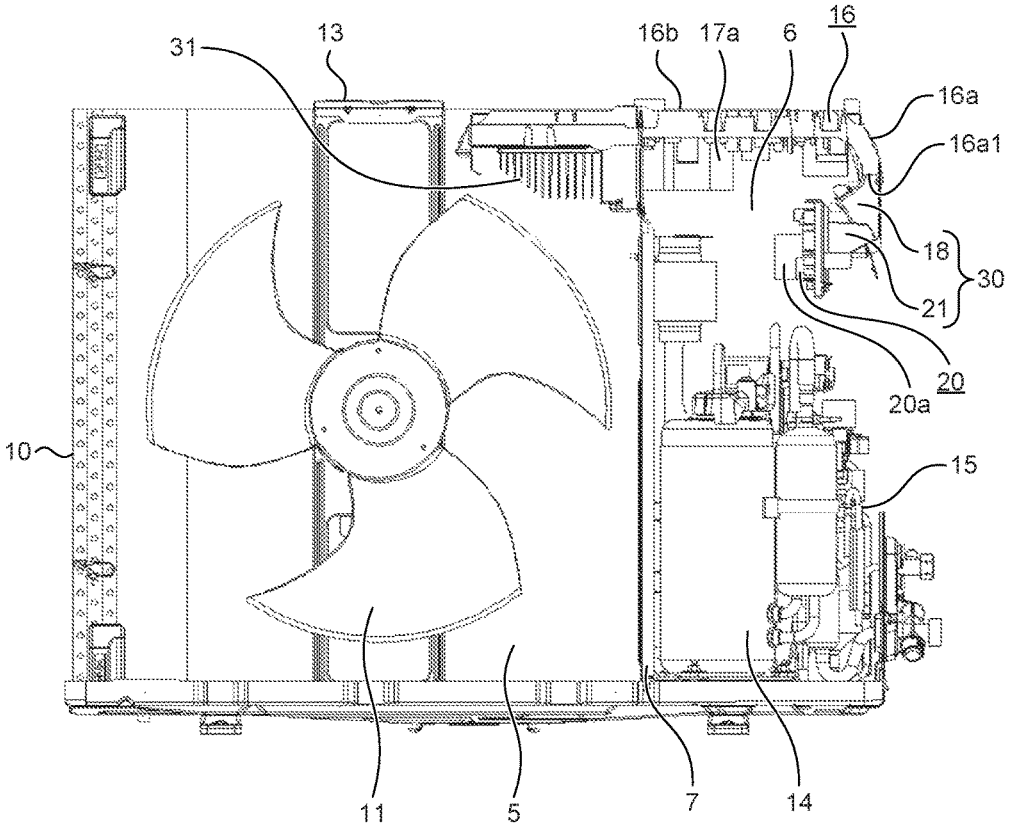
FIG. 4 is a front view of the outdoor unit illustrated in FIG. 3.
Figure 5:
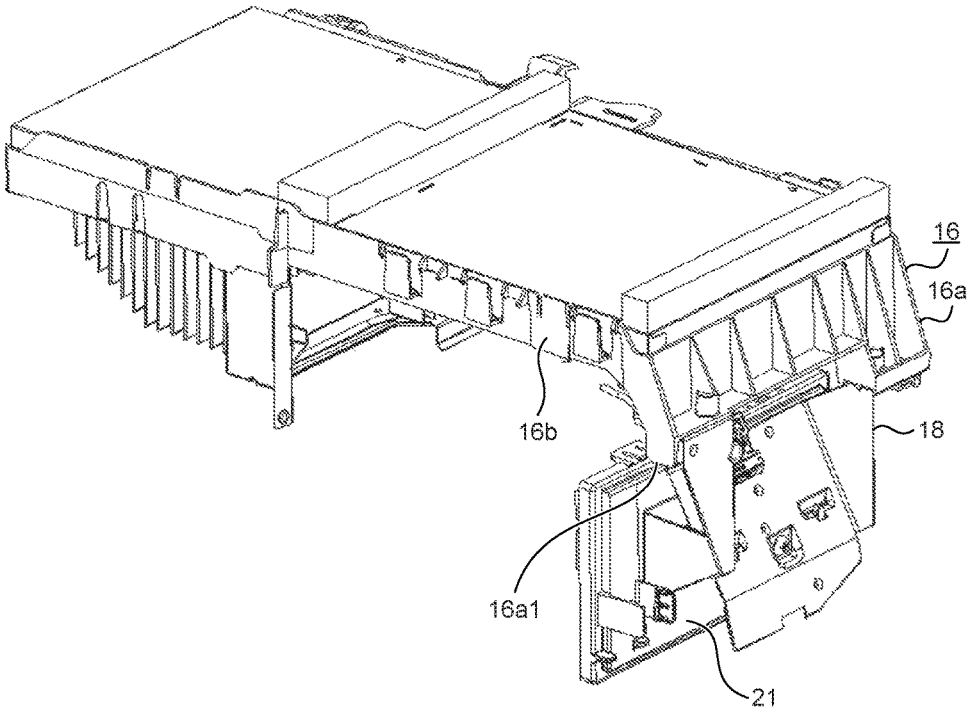
FIG. 5 is a perspective view of the electrical-part storage before it is attached to a main body of the outdoor unit, and a part fixing member and a board fixing member that are attached to the electrical-part storage.
Figure 6:
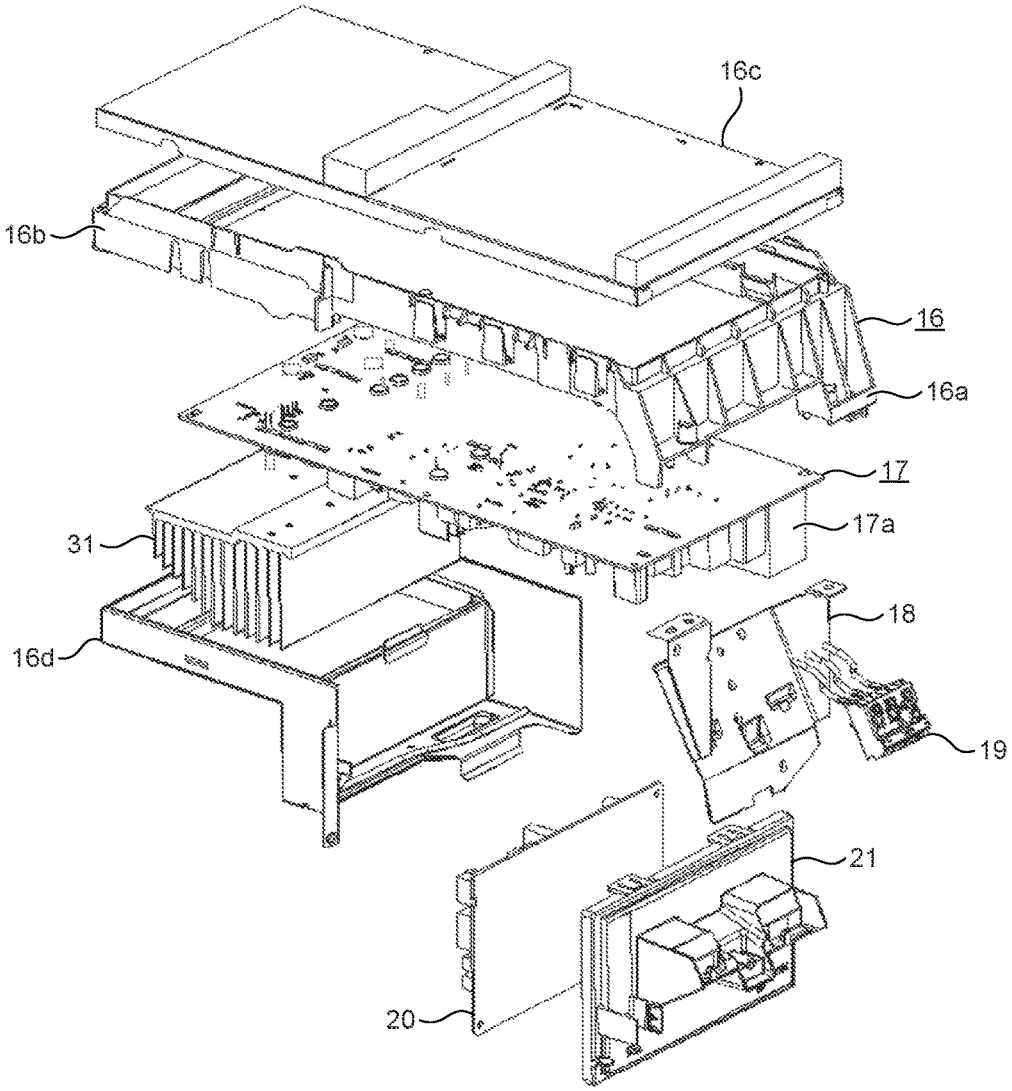
FIG. 6 is a perspective view of members and parts to be attached to the electrical-part storage.
Figure 7:
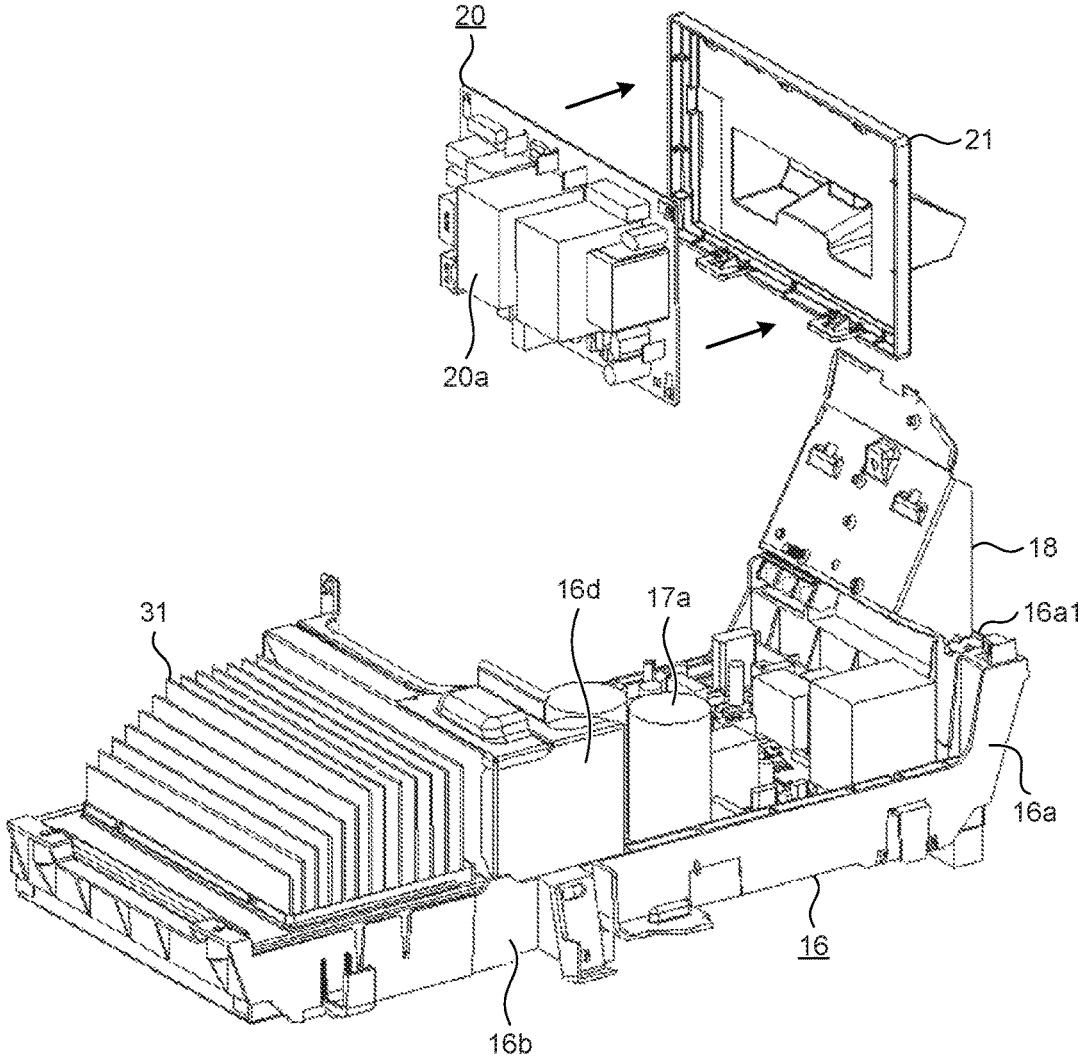
FIG. 7 is a perspective view of the board fixing member before it is attached to the electrical-part storage, and an auxiliary board before it is attached to the board fixing member.
Figure 8:
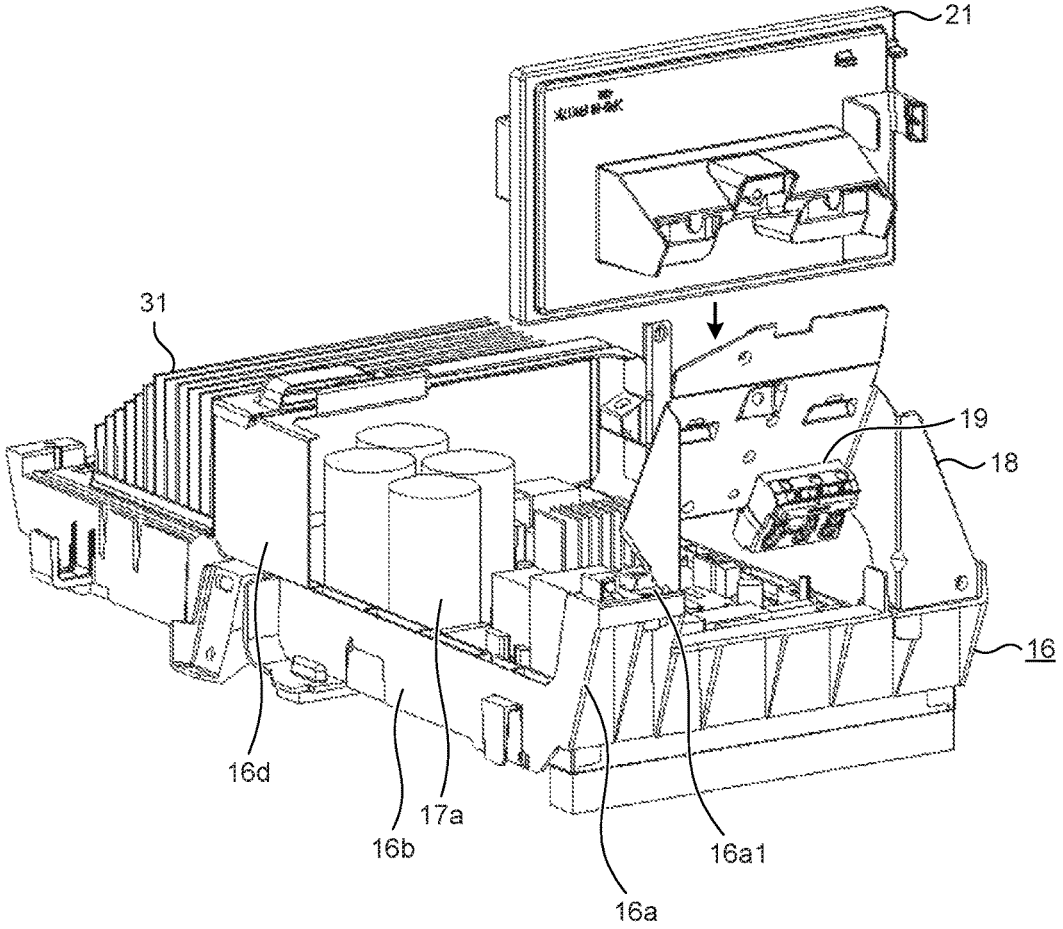
FIG. 8 is a perspective view of the board fixing member before it is attached to the electrical-part storage.

FIG. 1 is an exterior perspective view of an outdoor unit 100 of an air conditioner according to an embodiment of the present invention. FIG. 2 is an exploded perspective view of the outdoor unit 100 illustrated in FIG. 1. FIG. 3 is an interior perspective view of the outdoor unit 100 with a board fixing portion 30 attached to an electrical-part storage 16. FIG. 4 is an interior front view of the outdoor unit 100 illustrated in FIG. 3. FIG. 5 is a perspective view of the electrical-part storage 16 before it is attached to the main body of the outdoor unit, and a part fixing member 18 and a board fixing member 21 that are attached to the electrical-part storage 16. FIG. 6 is a perspective view of members and parts to be attached to the electrical-part storage 16. FIG. 7 is a perspective view of the board fixing member 21 before it is attached to the electrical-part storage 16, and an auxiliary board 20 before it is attached to the board fixing member 21. FIG. 8 is a perspective view of the board fixing member 21 before it is attached to the electrical-part storage 16.

As illustrated in FIGS. 1 and 2, the outdoor unit 100 is covered with a front plate 1, an outdoor-unit side plate 2, and a top plate 3 that constitute the outer casing of the outdoor unit 100. The outdoor-unit side plate 2 is formed into an L-shaped cross section so as to cover the side surface of a machine compartment 6 and a part of the back surface of the machine compartment 6. The outdoor-unit side plate 2 is formed with an opening 2*a* for electrical wiring. A protective cover 4 is disposed on the outdoor-unit side plate 2 so as to cover this opening 2*a*. The interior of the outdoor unit 100 is divided into an air blower compartment 5 and the machine compartment 6. Specifically, a partition plate 7 is provided to stand vertically on the upper surface of a bottom plate 9 having leg portions 8. The interior of the outdoor unit 100 is divided by the partition plate 7 serving as the border into the air blower compartment 5 on one side of the partition plate 7 and the machine compartment 6 on the other side of the partition plate 7. Each of the parts within the outdoor unit 100 is held on the upper surface of the bottom plate 9.

In the machine compartment 6, a compressor unit 14, the part fixing member 18, the board fixing member 21, the auxiliary board 20, a refrigerant pipe 15, and the electrical-part storage 16 are installed. In the air blower compartment 5, a heat exchanger 10, a motor mounting table 13, which holds a motor 12, and a propeller fan 11, which is fixed to the rotary shaft of the motor 12, are installed.

As illustrated in FIGS. 4 to 6, the electrical-part storage 16 is configured from a board attachment portion 16*b*, a bottom plate 16*c*, a frame body 16*d*, and a fixing-member installation portion 16*a*, for example. The board attachment portion 16*b* is formed into a frame shape. For example, the board attachment portion 16*b* is disposed such that it extends in the horizontal direction of the casing of the outdoor unit 100 so as to extend across the machine compartment and the air blower compartment at the top end of the partition plate 7. A control board 17 is attached to the inner peripheral portion of the board attachment portion 16*b*.

Various types of electrical parts 17*a* for controlling a compressor (not illustrated) of the compressor unit 14 and for controlling the motor 12 are mounted on the control board 17, for example. On the control board 17, a radiator 31, which cools the electrical parts 17*a*, is disposed such that it is located on the air blower compartment 5 side. On the auxiliary board 20, parts for suppressing noise generated by the electrical parts provided on the control board 17, and parts required for adding an additional function such as a communication function are mounted.

The bottom plate 16*c* is attached to the section of the board attachment portion 16*b* on the top plate 3 side (see FIG. 2), and is interposed between the top plate 3 and the control board 17. The frame body 16*d* is attached to the section of the board attachment portion 16*b* on the side opposite to the top plate 3, and is formed to surround the periphery of the radiator 31. Providing the frame body 16*d* can prevent dust and small animals that are in the air blower compartment 5 from entering the control board 17 from the gap between the board attachment portion 16*b* and the radiator 31.

The fixing-member installation portion 16*a* is formed in such a manner that its end at the section of the board attachment portion 16*b* located in the machine compartment 6, where the section is opposed to the outdoor-unit side plate 2, is integral with the board attachment portion 16*b*, and the fixing-member installation portion 16*a* bends downward from the board attachment portion 16*b*. Between the auxiliary board 20 and an end portion 16*a*1 of the fixing-member installation portion 16*a* on the outdoor-unit side plate 2 side, a board fixing portion 30 for fixing the auxiliary board 20 thereto is installed in such a manner that electrical parts 20*a* installed on the auxiliary board 20 are disposed opposed to the partition plate 7. For example, the board fixing portion 30 includes the part fixing member 18 and the board fixing member 21.

FIG. 6 illustrates an example of members and parts to be attached to the electrical-part storage 16. The control board 17 is attached to the inner peripheral portion of the board attachment portion 16*b*. The bottom plate 16*c* is attached to the section of the board attachment portion 16*b* on the top plate 3 side. The frame body 16*d* is attached to the section of the board attachment portion 16*b* on the side opposite to the top plate 3. Providing the frame body 16*d* can prevent dust and small animals that are present in the air blower compartment 5 from entering the control board 17 from the gap between the board attachment portion 16*b* and the radiator 31. As illustrated in FIGS. 7 and 8, the auxiliary board 20 is attached to the board fixing member 21. The board fixing member 21 having the auxiliary board 20 attached thereto is attached to the part fixing member 18 by sliding it in the arrow direction illustrated in FIG. 8, that is, downwardly from above the part fixing member 18. The board fixing member 21 is disposed on the surface of the part fixing member 18 opposite to the surface on which a terminal block 19 is installed.

Figure 9:
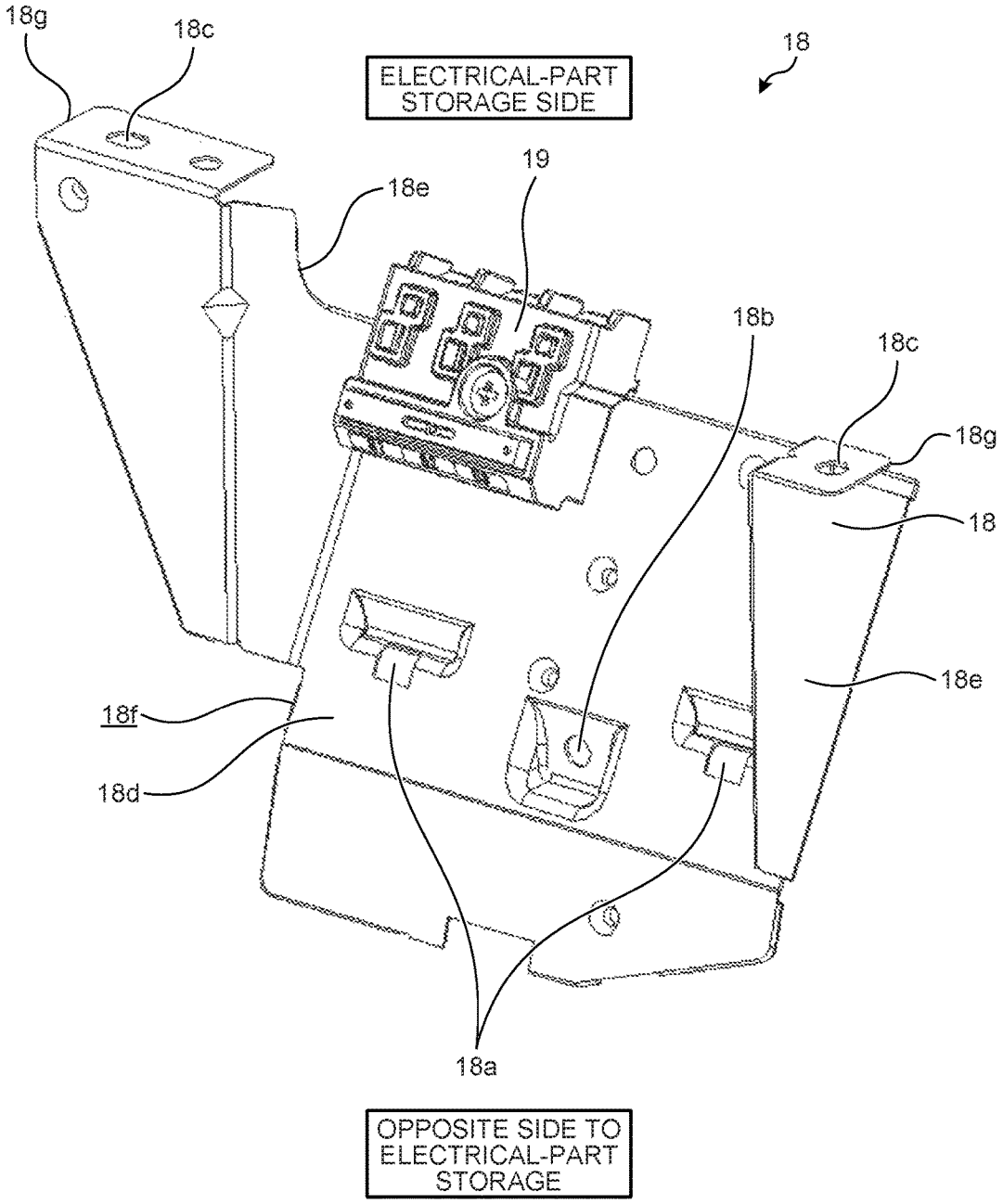
FIG. 9 is a perspective view of the part fixing member with a terminal block attached thereto.
Figure 10:
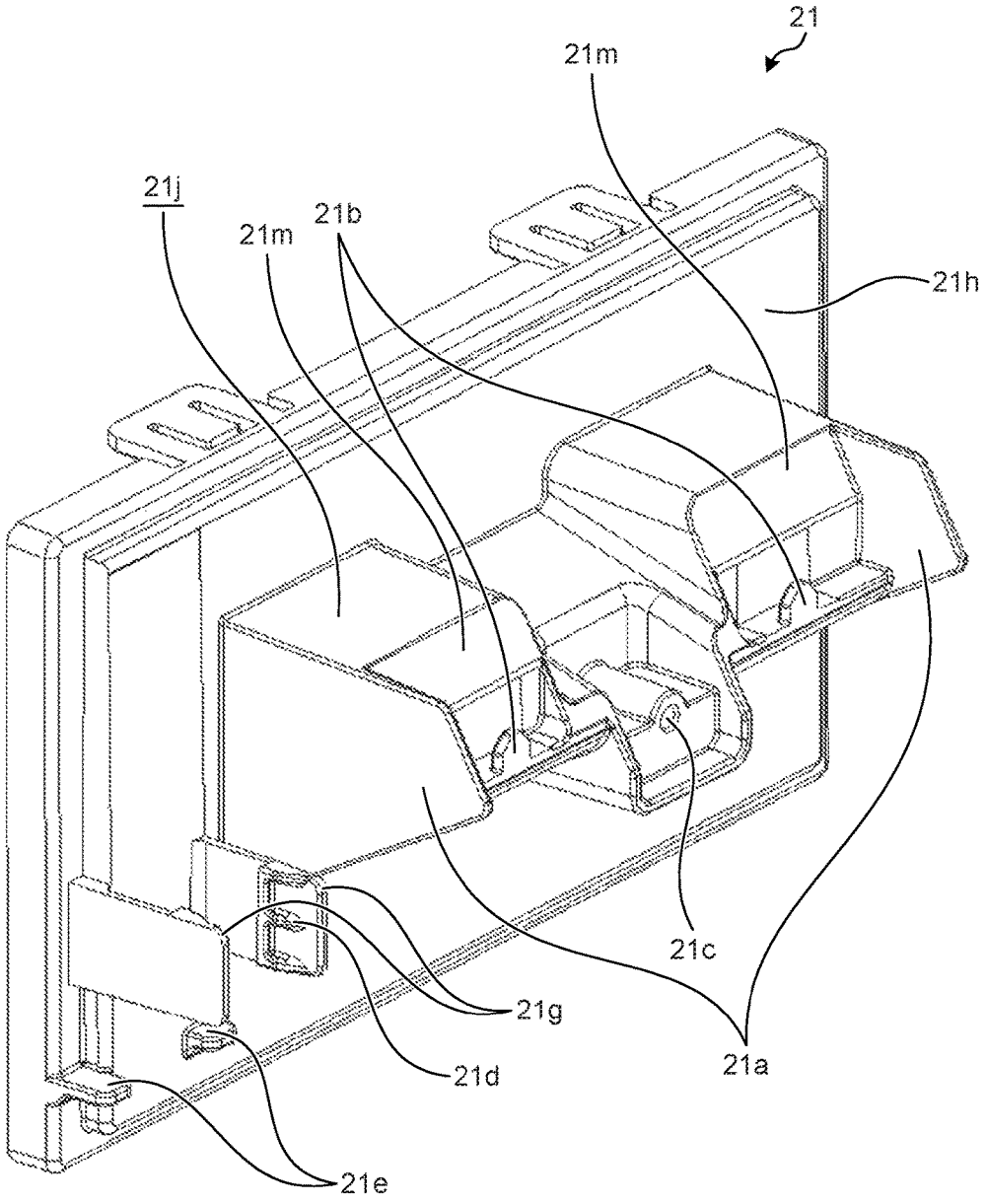
FIG. 10 is a perspective view of the board fixing member as viewed from an outdoor-unit side surface side.
Figure 11:
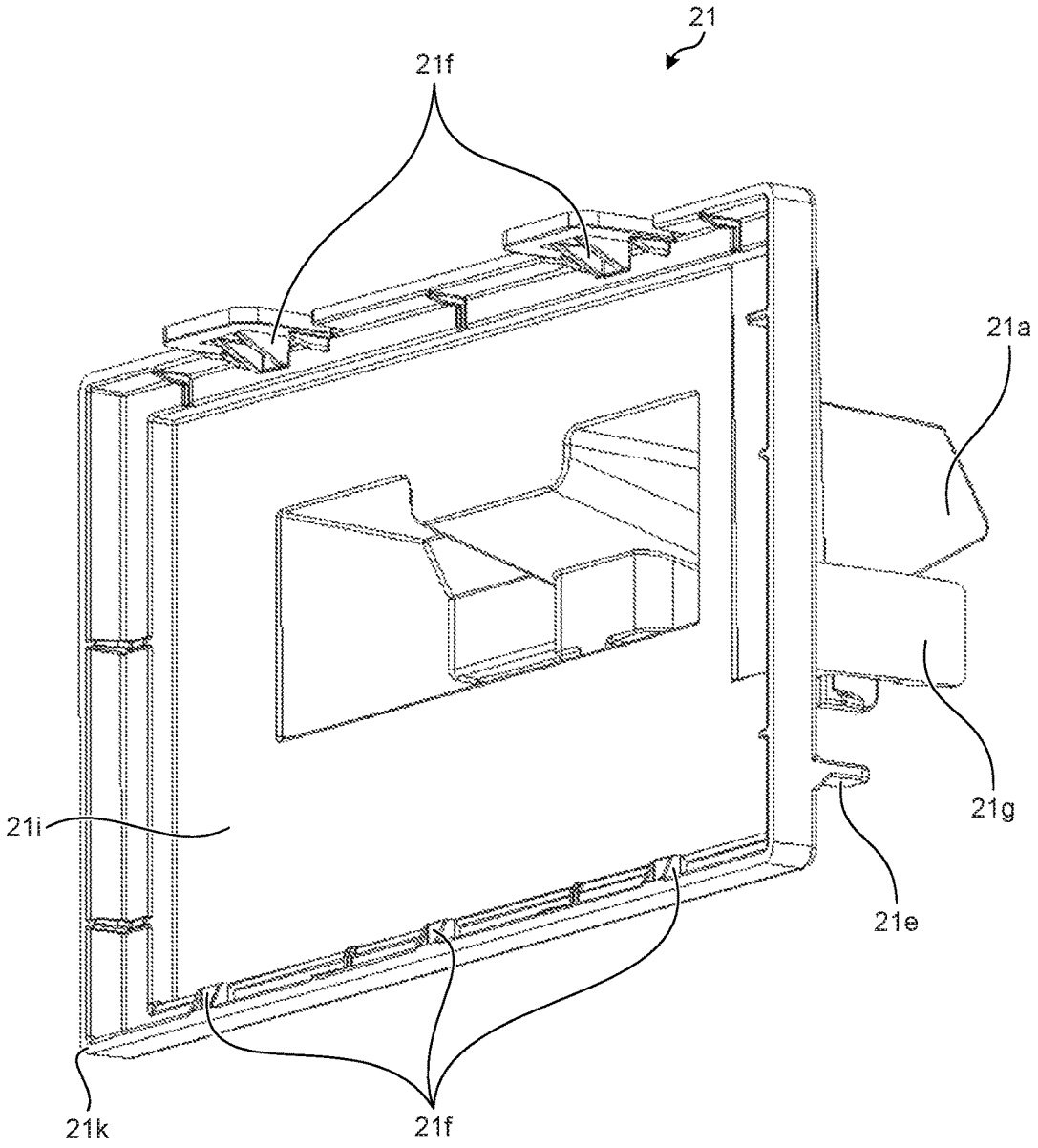
FIG. 11 is a perspective view of the board fixing member as viewed from the side opposite to the outdoor-unit side plate.
Figure 12:
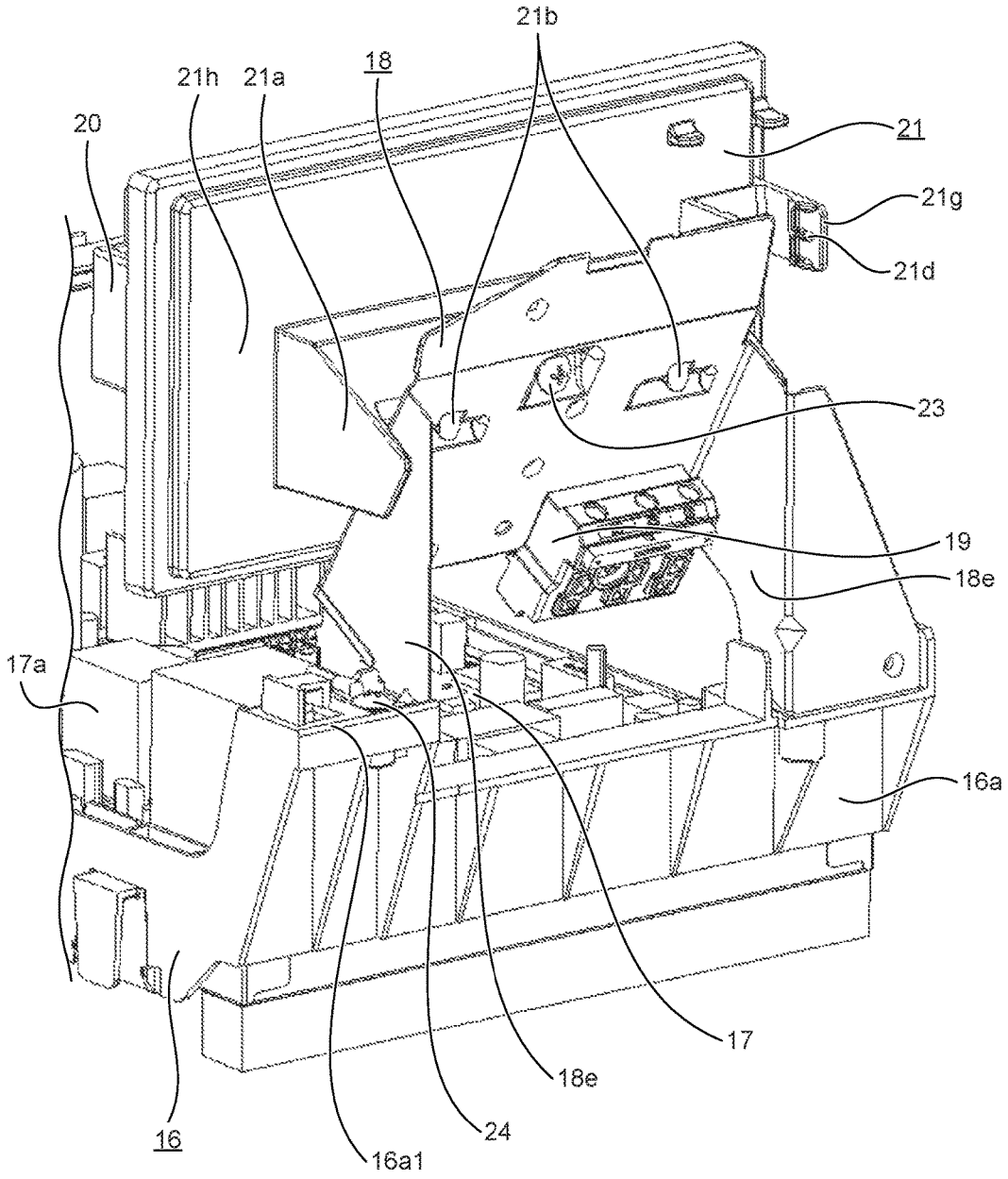
FIG. 12 is a perspective view of the board fixing member in a state of being fixed to the part fixing member.
Figure 13:
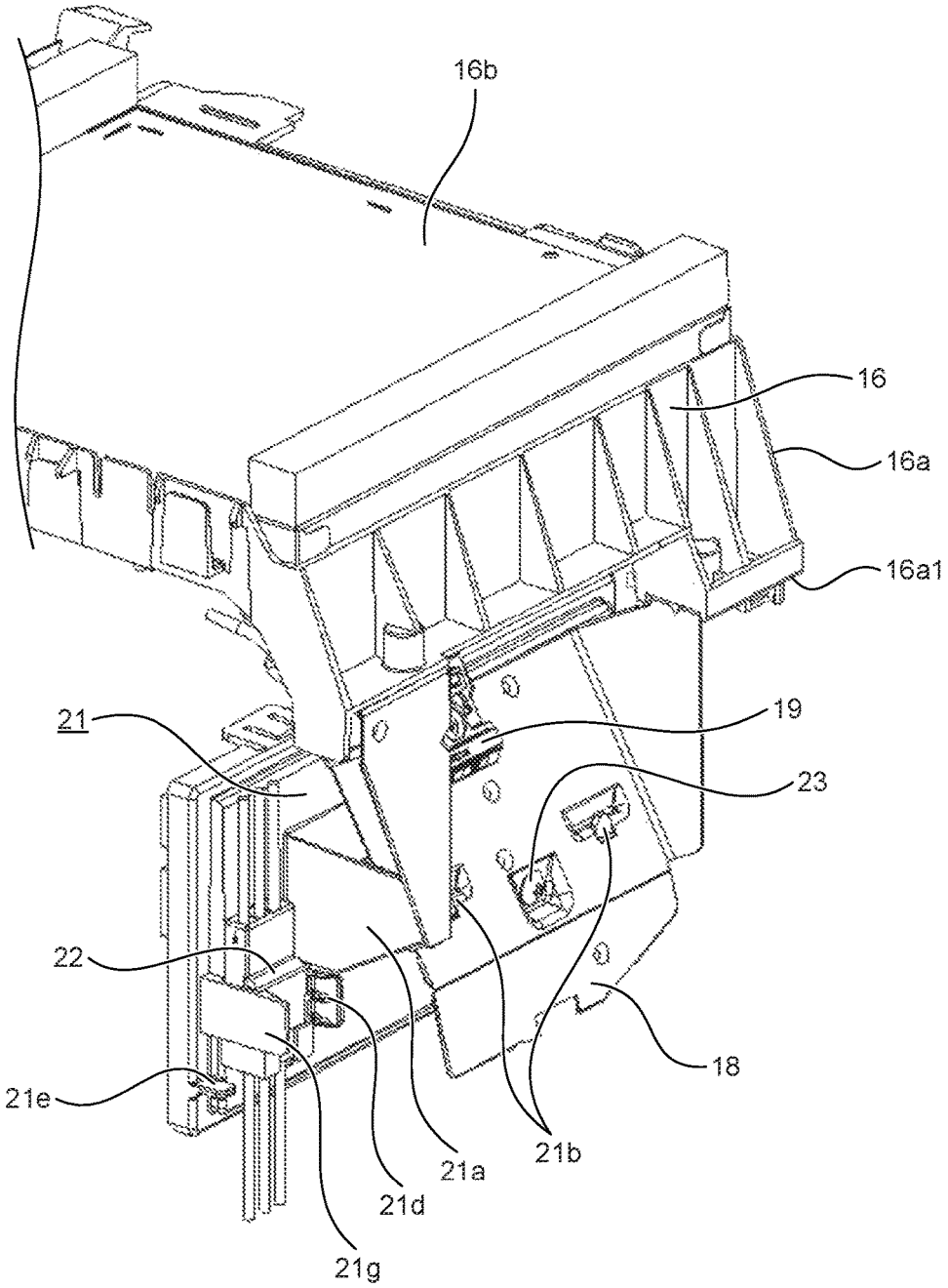
FIG. 13 is a partially enlarged view of FIG. 5.
Figure 14:
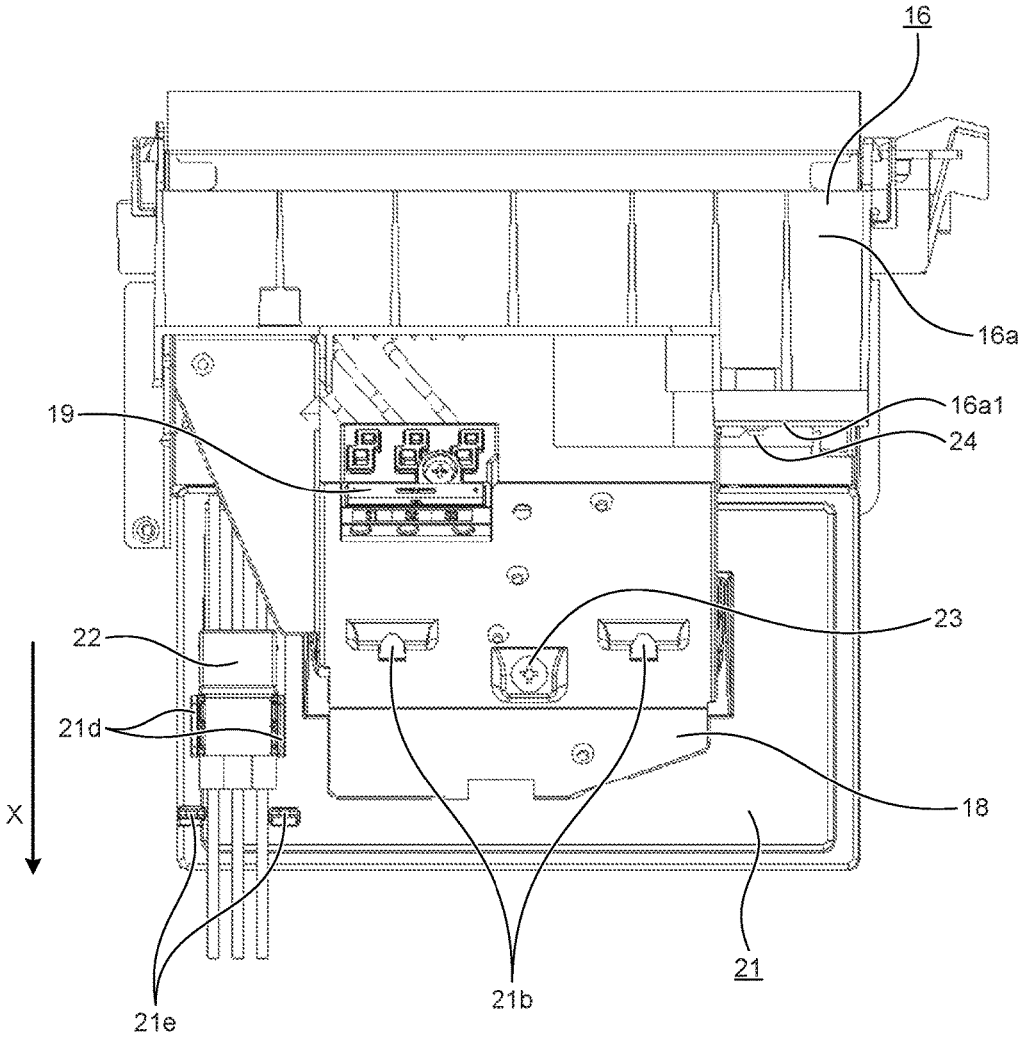
FIG. 14 is a diagram of the board fixing member and the part fixing member illustrated in FIG. 13 as viewed from the outdoor-unit side plate side.

Next, configurations of the part fixing member 18 and the board fixing member 21 are specifically described with reference to FIGS. 9 to 14. FIG. 9 is a perspective view of the part fixing member 18 with the terminal block 19 attached thereto. FIG. 10 is a perspective view of the board fixing member 21 as viewed from the outdoor-unit side plate 2 side. FIG. 11 is a perspective view of the board fixing member 21 as viewed from the side opposite to the outdoor-unit side plate 2. FIG. 12 is a perspective view of the board fixing member 21 in a state of being fixed to the part fixing member 18. FIG. 13 is a partially enlarged view of FIG. 5. FIG. 14 is a diagram of the board fixing member 21 and the part fixing member 18 illustrated in FIG. 13 as viewed from the outdoor-unit side plate 2 side.

As illustrated in FIG. 9, the part fixing member 18 is formed into a rectangular U-shaped cross section by bending both ends of a metallic plate member, for example. The part fixing member 18 is configured to include a part-installation surface 18*f* on which the terminal block 19 and the board fixing member 21 are installed, and guide surfaces 18*e* that are formed at both ends of the part-installation surface 18*f* and that come in contact with guide pieces 21*a* of the board fixing member 21 (see FIG. 10).

In the part-installation surface 18*f*, two openings 18*a* and one screw hole 18*b* are formed. Each of the openings 18*a* is formed in such a manner that a catch 21*b* (see FIG. 10) of a fixing member 21*j* of the board fixing member 21 is engaged with the opening 18*a*.

The screw hole 18*b* is formed in such a manner that it communicates with a screw hole 21*c* of the board fixing member 21 when the catches 21*b* of the board fixing member 21 are engaged with the openings 18*a*. A screw 23 (see FIG. 12) is inserted into the screw hole 18*b* from the outdoor-unit side plate 2 side of the part-installation surface 18*f*.

The two guide surfaces 18*e* are provided with respective seat portions 18*g* at the ends of the guide surfaces 18*e* on the electrical-part storage side. The seat portions 18*g* are provided to fix the part fixing member 18 to the end portion 16*a*1 (see FIG. 12) of the fixing-member installation portion 16*a*. A screw hole 18*c* is formed in each of the seat portions 18*g*. Screws 24 (see FIG. 12) for fixing the seat portions 18*g* to the end portion 16*a*1 of the fixing-member installation portion 16*a* are inserted into the screw holes 18*c*.

The part-installation surface 18*f* of the part fixing member 18 is inclined in such a manner that the width between the outdoor-unit side plate 2 (see FIG. 2) and the part-installation surface 18*f* is reduced from the electrical-part storage 16 side toward the side opposite to the electrical-part storage 16. The terminal block 19 is screwed onto the part-installation surface 18*f*. For example, the terminal block 19 is provided to connect wires that electrically connect the outdoor unit 100 with an indoor unit (not illustrated).

As illustrated in FIG. 10, a counter-partition-plate-side surface 21*h* of the board fixing member 21 is formed with the fixing member 21*j* for fixing the board fixing member 21 to the part fixing member 18, a connector fixing portion 21*g* for fixing a lead connector 22 (see FIG. 13) to the board fixing member 21, and stoppers 21*e* that are located below the connector fixing portion 21*g* to restricts the downward movement of the lead connector 22. The board fixing member 21 is made of insulating resin, for example, in order to provide electrical insulation between the part fixing member 18 and the auxiliary board 20.

The fixing member 21*j* is formed into a convex shape projecting from the counter-partition-plate-side surface 21*h* toward the outdoor-unit side plate 2. At the end portion of the fixing member 21*j*, contact surfaces 21*m*, which come in contact with the part-installation surface 18*f* of the part fixing member 18, and two guide pieces 21*a* are formed. Each of the guide pieces 21*a* regulates the lateral positional displacement of the board fixing member 21 relative to the part fixing member 18 when the board fixing member 21 is attached to the part fixing member 18 by sliding it downward from above the part fixing member 18. The guide pieces 21*a* are formed such that they come into contact with the two guide surfaces 18*e* of the part fixing member 18.

As illustrated in FIG. 11, a partition-plate-side surface 21*i* of the board fixing member 21 is formed with a surrounding wall 21*k*, which is formed so as to surround the periphery of the partition-plate-side surface 21*i*, and a plurality of catches 21*f*, which are provided on the inner peripheral side of the surrounding wall 21*k* to fix the auxiliary board 20 (see FIG. 4) to the board fixing member 21. The auxiliary board 20 is combined with the board fixing member 21 on the inner peripheral side of the surrounding wall 21*k* such that the outer peripheral portion of the auxiliary board 20 is engaged with the catches 21*f*. With this configuration, the auxiliary board 20 is fixed to the board fixing member 21.

FIG. 12 illustrates the board fixing member 21 in a state of being fixed to the part fixing member 18. As illustrated in the example, in a case of fixing the board fixing member 21 to the part fixing member 18, the electrical-part storage 16 is first installed in such a manner that the end portion 16*a*1 of the fixing-member installation portion 16*a* is directed upward, and then the part fixing member 18 is fixed to the end portion 16*a*1 by the screws 24 (see FIG. 8). Next, the board fixing member 21 is attached to the part fixing member 18 in a downwardly sliding manner from above the part fixing member 18 in such a manner that the guide pieces 21*a* of the board fixing member 21 come into contact with the guide surfaces 18*e* of the part fixing member 18. Upon insertion of the catches 21*b* of the board fixing member 21 into the openings 18*a* of the part fixing member 18, the board fixing member 21 is temporarily fixed to the part fixing member 18. This brings the board fixing member 21 to a state where it is not removed from the part fixing member 18 even when the board fixing member 21 is released from worker's hands. Therefore, fixing of the board fixing member 21 to the part fixing member 18 with the screw 23 can be performed more efficiently.

After the board fixing member 21 is fixed in the manner as described above, the electrical-part storage 16 that has been inverted to direct the end portion 16*a*1 of the fixing-member installation portion 16*a* downward as illustrated in FIGS. 13 and 14 is disposed in the main body of the outdoor unit, for example, at the top end of the partition plate 7 in FIG. 4. Thereafter, the lead connector 22 is fixed in such a manner as to be engaged with the catches 21*d* of the connector fixing portion 21*g*. This can simplify wiring of the leads connected to the lead connector 22, and also can prevent degradation in the wiring workability as well as faulty wiring. Further, even when a load is applied to the leads in the direction of their own weight, that is, in the X-direction in FIG. 14, the lead connector 22 is still caught by the stoppers 21*e* disposed below the connector fixing portion 21*g*. This can prevent the lead connector 22 from coming away from the connector fixing portion 21*g*.

Further, the terminal block 19 is installed on the outdoor-unit side plate 2 side of the part-installation surface 18*f*, that is, on an opposed surface 18*d* side to the outdoor-unit side plate 2. Therefore, as compared to the case, for example, where the terminal block 19 is installed between the auxiliary board 20 and the control board 17, the number of wires that are present in an empty space between the auxiliary board 20 and the control board 17 is reduced. This can simplify the wiring.

As described above, because the part-installation surface 18*f* is inclined, the terminal block 19 is fixed to the part-installation surface 18*f* with its front surface positioned obliquely upward. Therefore, the connection point of the leads to the terminal block 19 can be easily identified, and thus the workability of wiring to the terminal block 19 is improved and faulty wiring can be prevented.

Next, an operation of the outdoor unit 100 is described. When an operation command is transmitted from an indoor unit (not illustrated) to the control board 17 of the outdoor unit 100, the control board 17 that has received the operation command controls the compressor unit 14 at an appropriate rotation speed. When the compressor unit 14 starts operating, a refrigerant circulates in the heat exchanger 10. Heat is exchanged between the refrigerant and the air around the heat exchanger 10. At this time, the control board 17 also controls rotations of the motor 12. A negative pressure is generated by rotations of the propeller fan 11 attached to the motor 12, and the air at the side and back of the outdoor unit is introduced into the air blower compartment 5. An air flow generated at this time passes through the heat exchanger 10, which promotes the heat exchange. Heat generated from the parts provided on the control board 17 is radiated into the air blower compartment 5 via the heat radiator 31. Heat radiation is promoted by an air flow that passes through the air blower compartment 5. The air flow introduced into the air blower compartment 5 is led to the air outlet of the front plate 1 to flow to the outside of the outdoor unit 100.

In the present embodiment, the part fixing member 18 is made of metal. By making the part fixing member 18 of metal, for example, even when a cable (not illustrated) wired to the opposite side of the part fixing member 18 to the electrical-part storage side catches fire, the fire can be prevented from spreading to the control board 17 because the part fixing member 18 is flame retardant. Also in a case where the part fixing member 18 is made of a material other than metal, for example, the same material as that of the board fixing member 21 or the electrical-part storage 16, the workability of various types of wiring within the machine compartment 6, and the serviceability with regard to board replacement are improved as compared to the conventional technique described above, because the auxiliary board 20 is disposed on the partition-plate-side surface 21*i* (see FIG. 11) of the board fixing member 21.

In the present embodiment, the board fixing member 21 includes the guide pieces 21*a*. Therefore, the work efficiency when the board fixing member 21 is fixed to the part fixing member 18 can be improved. Even when the guide pieces 21*a* are not formed on the board fixing member 21, the board fixing member 21 can still be fixed to the part fixing member 18. Therefore, the auxiliary board 20 can be installed in such a manner as to efficiently use the empty space of the machine compartment 6.

The board fixing portion 30 in the present embodiment includes the part fixing member 18 and the board fixing member 21. However, for example, it suffices that the part fixing member 18 and the board fixing member 21 are molded integrally from the same material as the electrical-part storage 16, such as metal or resin, into a single member, and this member is used as the board fixing portion 30. In the case where the board fixing portion 30 is configured as described above, a wiring space is also ensured between the control board 17 and the auxiliary board 20. This can prevent degradation in the wiring workability as well as faulty wiring.

In the electrical-part storage 16 in the illustrated example, the board attachment portion 16*b*, to which the control board 17 is attached, and the fixing-member installation portion 16*a*, on which the board fixing portion 30 is mounted, are formed integrally. However, it suffices that the board attachment portion 16*b* and the fixing-member installation portion 16*a* are separately manufactured and these portions are combined together as the electrical-part storage 16. Even in the case where the electrical-part storage 16 is configured as described above, it is still possible to fix the board fixing portion 30 to the electrical-part storage 16. However, as illustrated in the example, when the electrical-part storage 16 is integrally formed of a resin material, the manufacturing costs can be reduced as compared to the case where the board attachment portion 16*b* and the fixing-member installation portion 16*a* are separately manufactured.

As described above, the outdoor unit 100 of an air conditioner according to the present embodiment includes the partition plate 7 that separates the machine compartment 6 and the air blower compartment 5; the electrical-part storage 16 that is disposed so as to extend from the machine compartment 6 side of the partition plate 7 to the air blower compartment 5 side of the partition plate 7 and that stores therein the electrical parts 17*a*; the auxiliary board 20 that is disposed in the machine compartment 6 and that is a board on which the electrical parts 20*a* other than the electrical parts 17*a* installed in the electrical-part storage 16 are installed; and the board fixing portion 30 that is interposed between the electrical-part storage 16 located in the machine compartment 6 and the auxiliary board 20 to fix the auxiliary board 20 thereto. In the above conventional technique, an auxiliary board is located on the lower surface side of a protective cover that covers a control board. That is, the electrical parts installed on the auxiliary board are disposed so as to be opposed to the electrical parts installed on the control board. Therefore, there is almost no wiring space between the control board and the auxiliary board. This degrades the workability of various types of wiring within the machine compartment. Further, because it is difficult to visually recognize the wiring locations, this may cause faulty wiring. Furthermore, there is a problem in that the serviceability with regard to board replacement is degraded. In contrast thereto, in the outdoor unit 100 according to the present embodiment, the auxiliary board 20 can be fixed in such a manner that the electrical parts 20*a* are disposed to be opposed to the partition plate 7. Therefore, without changing the size of the control board 17, the wiring space can be ensured between the control board 17 and the auxiliary board 20. This can prevent degradation in the wiring workability as well as faulty wiring.

Further, the peripheral parts around the control board and the conventional parts can be common parts, and therefore the outdoor unit of an air conditioner with high serviceability can be obtained. There is no need to increase the size of the control board 17 and the peripheral parts around the control board 17 can be standardized. Accordingly, not only the manufacturing yield of the constituent parts of the outdoor unit 100 is improved, but also a reduction in volume of the row materials of these constituent parts and a reduction in amount of packaging can both be achieved. Furthermore, the transport efficiency of these constituent parts or the completed outdoor unit 100 can be improved.

The configuration described in the above embodiment is only an example of the configuration of the present invention. The configuration can be combined with other publicly known techniques, and it is needless to mention that the present invention can be configured while modifying it without departing from the scope of the invention, such as omitting a part of the configuration.

INDUSTRIAL APPLICABILITY

As described above, the present invention can be applicable to an outdoor unit of an air conditioner, and is particularly useful as an invention that can achieve further improvement in the productivity and serviceability.

The invention claimed is:

1. An outdoor unit of an air conditioner, comprising:

a partition plate that separates a machine compartment and an air blower compartment, wherein the partition plate has a first side facing the machine compartment and a second side facing the air blower compartment;

an electrical-part storage that is located to extend from the first side of the partition plate to the second side of the partition plate and that stores therein an electrical part, wherein the electrical-part storage has an end located in the machine compartment;

a board that is located in the machine compartment and on which an electrical part, which is other than the electrical part installed in the electrical-part storage, is installed;

a board fixing member that is located between the board and the end of the electrical-part storage located in the machine compartment, wherein the board fixing member fixes the board to the electrical part storage such that the board is opposed to the first side of the partition plate; and a metallic part fixing member that fixes the board fixing member to the electrical-part storage, wherein the board fixing member, to which the board is fixed, is configured to be attached to the part fixing member by sliding the board fixing member in a vertical direction relative to the part fixing member.

2. The outdoor unit of an air conditioner according to claim 1, wherein the part fixing member has an outer side and an inner side, the inner side is opposite to the outer side, the inner side faces the first side of the partition plate, and a terminal block is installed on the outer side of the part fixing member.

3. The outdoor unit of an air conditioner according to claim 2, wherein the board fixing member is located on the inner side of the part fixing member.

4. The outdoor unit of an air conditioner according to claim 1, wherein the part fixing member has an opening formed therein, and the board fixing member includes a catch, which is configured to be inserted into the opening formed in the part fixing member.

5. The outdoor unit of an air conditioner according to claim 4, wherein the part fixing member has an outer side and an inner side, wherein the inner side is opposite to the outer side, the inner side faces the first side of the partition plate, and each of the board fixing member and the part fixing member includes an insertion hole for a screw to be inserted from the outer side of the part fixing member in a state where the catch is engaged with the opening.

6. The outdoor unit of an air conditioner according to claim 1, wherein the part fixing member includes a guide surface that regulates positional displacement of the board fixing member relative to the part fixing member, and the board fixing member includes a guide piece that comes in contact with the guide surface.

7. The outdoor unit of an air conditioner according to claim 6, wherein the part fixing member has an opening formed therein, the board fixing member includes a catch, which is configured to be inserted into the opening formed in the part fixing member, the part fixing member has an outer side and an inner side, the inner side is opposite to the outer side, the inner side faces the first side of the partition plate, and each of the board fixing member and the part fixing member includes an insertion hole for a screw to be inserted from the outer side of the part fixing member in a state where the catch is engaged with the opening.

8. The outdoor unit of an air conditioner according to claim 1, wherein the board fixing member has an outer side and an inner side, the inner side is opposite to the outer side, the inner side faces the first side of the partition plate, and the board fixing member includes a connector fixing portion located on the outer side of the board fixing member for fixing a lead connector to the board fixing member.

9. The outdoor unit of an air conditioner according to claim 1, wherein the board fixing member has an outer side and an inner side, the inner side is opposite to the outer side, the inner side faces the first side of the partition plate, and the board fixing member includes a stopper located on the outer side of the board fixing member for restricting downward movement of a lead connector.

* * * * *